United States Patent [19]

Guiffray

[11] Patent Number: 4,928,852

[45] Date of Patent: May 29, 1990

[54] CONTAINER OF FLEXIBLE MATERIAL FOR RECEIVING A LIQUID

[76] Inventor: Michel Guiffray, 136 Rue Vulfran Warmé , 80000 Amiens, France

[21] Appl. No.: 898,879

[22] Filed: Aug. 21, 1986

Related U.S. Application Data

[63] Continuation of Ser. No. 574,457, Jan. 27, 1984, abandoned.

[30] Foreign Application Priority Data

Jan. 28, 1983 [FR] France ..... 83 01359

[51] Int. Cl.[5] ..... B65D 37/00

[52] U.S. Cl. ..... 222/107; 222/212; 222/215; 222/498; 383/907

[58] Field of Search ..... 222/92, 94, 107, 206, 222/207, 212, 215, 498, 541; 150/55; 383/907, 121, 104

[56] References Cited

U.S. PATENT DOCUMENTS

| | | | |
|---|---|---|---|
| 3,009,498 | 11/1961 | Fohr | 222/107 X |
| 3,074,612 | 1/1963 | Schneider | 229/7.5 X |
| 3,184,121 | 5/1965 | Volckening | 222/541 X |
| 3,612,133 | 10/1971 | Jarund | 383/907 X |
| 3,635,376 | 1/1972 | Hellstrom | 222/107 |
| 3,720,305 | 3/1973 | Barton | 206/620 X |
| 3,791,570 | 2/1974 | Hopkins | 222/107 X |
| 4,282,986 | 8/1981 | af Ekenstam | 222/215 X |
| 4,328,912 | 5/1982 | Haggar et al. | 222/212 |
| 4,592,493 | 6/1986 | Smith | 222/212 |

FOREIGN PATENT DOCUMENTS

| | | |
|---|---|---|
| 1065305 | 5/1954 | France . |
| 2160179 | 6/1973 | France . |

*Primary Examiner*—Kevin P. Shaver

*Attorney, Agent, or Firm*—Cushman, Darby & Cushman

[57] ABSTRACT

The container of flexible or semi-rigid material is adapted to receive a liquid such as a maintenance product and has two planar bearing sides 2 for bearing against a support plane 4, these sides forming a dihedron whose angle $\alpha$ is less than 90° when the container is filled with liquid and has its normal shape. The two halves 1 of the container are fixed together along a rigid assembly bead 3 and the container has spherical bulging portions 7 for closing the container. The container outlet is at the end opposite the apex of the dihedron and arranged so it is always above the liquid maximum level in the container when it is resting on one of the bearing sides.

5 Claims, 2 Drawing Sheets

9
VI
VI
V
V
3
9a
9a
11
9b
10
IV
IV
III
III
9b
12
14

II
α
4
2
2
N
1
5
6
3
1
5
7
7
8
8
14
II
P 9b
12
9b 7
11
9b
7
9b 1
9a
1
9a 9a
1
1
9a 2
1
3
2
1
7
8
8
14

CONTAINER OF FLEXIBLE MATERIAL FOR RECEIVING A LIQUID

This is a continuation of application Ser. No. 574,457, filed Jan. 27, 1984, now abandoned.

The present invention relates to a container of flexible material for receiving a liquid.

Containers of flexible material usually employed for a number of liquids, such as maintenance products, chemical products, etc., usually have the shape of bottles. Owing to this shape and the particular closing systems required therefor, which are more or less complicated, the cost of these flexible containers is relatively high.

An object of the invention is to provide a container of flexible or semi-rigid material, and in particular plastics material, which is capable of receiving the aforementioned liquids but which is of considerably reduced cost owing to a simplification of its structure and consequently of its method of production.

A further object of the invention is to provide such a container which is provided with a particularly simple and cheap closing device.

According to the invention, the container has two planar bearing sides forming a dihedron whose angle is less than 90° when the container is filled with liquid, and these two planar sides are interconnected by a neck at the end of which is formed an opening for expelling the liquid.

Thus, when the container is filled with liquid, it normally rests on either of the two planar bearing sides, the liquid outlet opening being formed in a median plane of the container with respect to which plane the two halves of the container are symmetrical. Owing to the angle made between the two bearing sides, the liquid expelling opening is never directed downwardly when the container rests on one of said bearing sides, so that the liquid cannot accidentally flow out of the container.

According to one embodiment of the invention, the container is formed by two semi-shells each having a bearing side and being fixed to each other by their periphery in a median plane with respect to which plane said two semi-shells are symmetrical, the fixing being preferably achieved by welding.

After the two semi-shells have been fixed together, their assembly line, which is contained in the median plane of symmetry of the container, stiffens the latter and thus permits the obtainment of the liquid expelling opening which is directed upwardly.

Further features and advantages of the invention will be apparent from the following description with reference to the accompanying drawings, in which one embodiment of the container according to the invention has been shown merely by way of example to which the scope of the invention is not intended to be limited.

Figure 2:
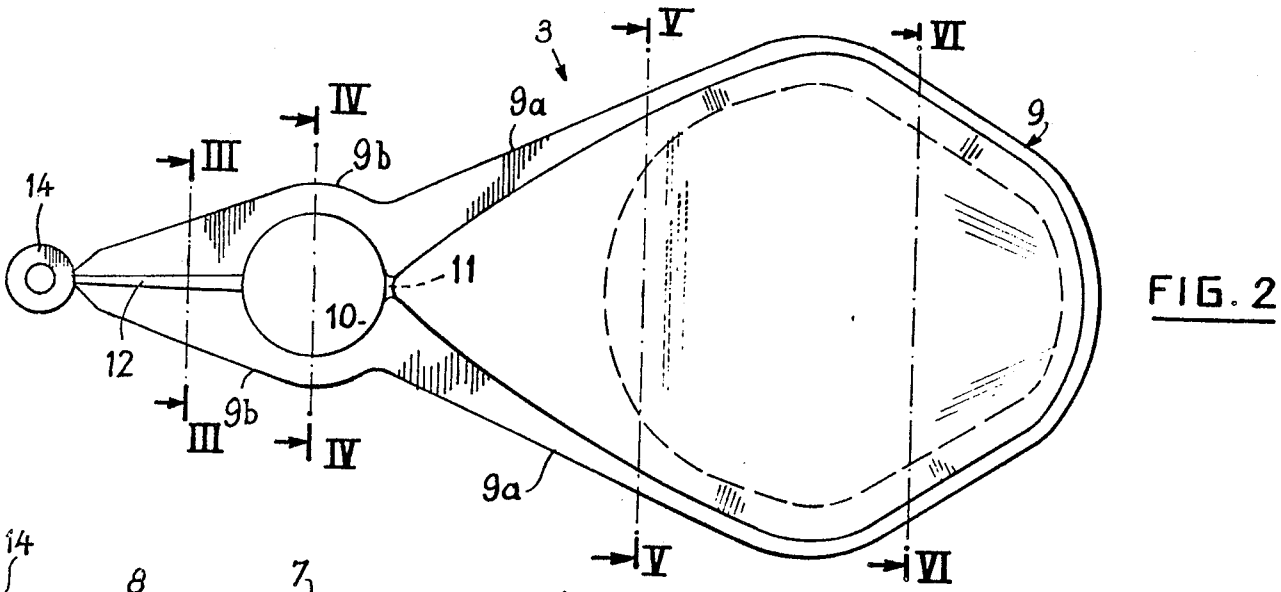
FIG. 2 is a sectional view taken along the median plane II—II of FIG. 1 of the container.

The container shown in the drawings is made from a suitable flexible or semi-rigid material, such as sheets or films of plastics material or complex material etc. and adapted to receive a liquid, such as a household maintenance product, it being understood that other liquids may of course be used.

This container has two flexible or semi-rigid semi-shells 1 which are symmetrical with each other relative to a median plane P embodied by a rigid and planar assembly bead 3. Each half or semi-shell 1 has a planar bearing side 2 for bearing against a surface 4 for supporting the container, and the sides 2 form therebetween a dihedron whose angle $\alpha$ (FIG. 1) is less than 90° when the container is filled with liquid and consequently the sides 2 are quite taut.

In the illustrated embodiment, the angle $\alpha$ is about 45°.

Each planar side 2 is extended at the end opposed to the edge of the dihedron, by a portion 5 which is inclined to the plane of symmetry P, these two portions 5 converging in such manner as to constitute a neck having an end opening 6. Beyond the opening 6, each flexible half 1 has a bulging portion 7 which has a hemispherical shape in the illustrated embodiment, these two bulging portions 7 together defining a sphere having a diametral plane P.

Beyond this sphere, the semi-shells 1 are extended by pointed portions 8 which are joined at their ends.

The symmetrical semi-shells 1 of the container are fixed to each other along their periphery, for example by thermowelding along an assembly bead 3 contaned in the median plane of symmetry P. This bead has a first loop 9 which has two branches **9*a* converging toward the liquid expelling opening. The branches 9*a* have end arms 9*b* which define therebetween a cavity 10, of circular contour in the illustrated embodiment, which communicates with the space between the branches 9*a* through an opening 11 of the neck formed by the branches 9*a*. The circular cavity 10 also opens onto a central passageway 12 whose end is closed by an end ring or closing means 14. The assembly bead 3 therefore has a closed contour in which are defined in succession a gap within the loop 9, a passage 11 putting this gap and the circular cavity 10 in communication with each other, and the passageway 12**.

Each of the semi-shells 1 constituting the container may be produced by thermoforming, thermoblowing, moulding etc., the container being obtained by a welding of these two semi-shells 1 together along their facing edge portions by means of a machine known per se, the liquid being introduced into the container, also in the known manner, in the course of the production of the container.

Figure 1:
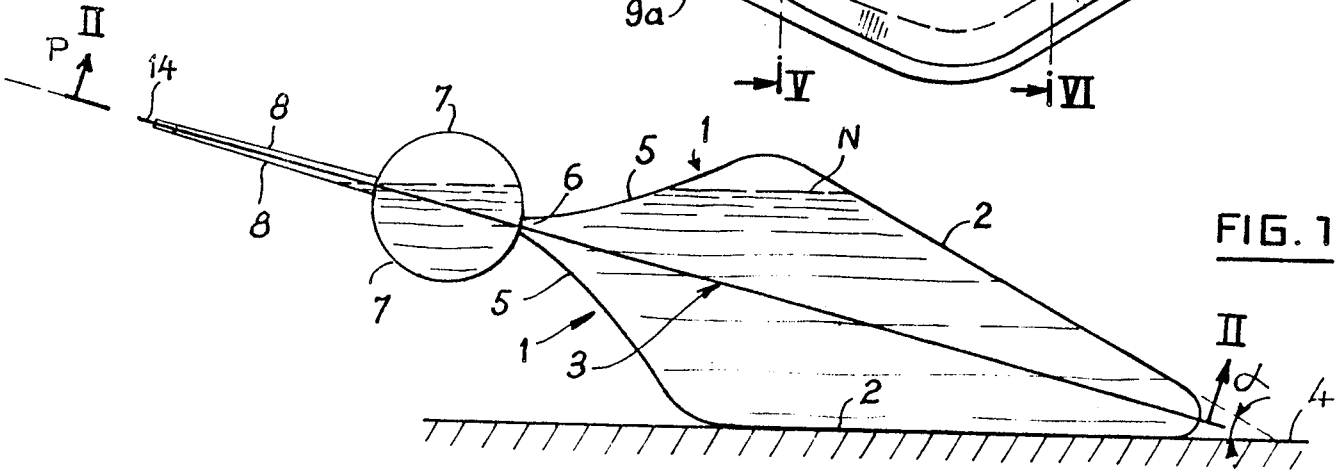
FIG. 1 is a side elevational view of the container according to the invention which is filled with liquid and rests on one of its planar sides.

To use the container, the end closing means 14 is detached or broken so as to open the end of the liquid outlet passageway 12 (the level N of this liquid is shown in FIG. 1), and a pressure is exerted on one of the planar sides 2 or simultaneously on both of the sides 2.

Figures 3, 4, 5, 6, 7:
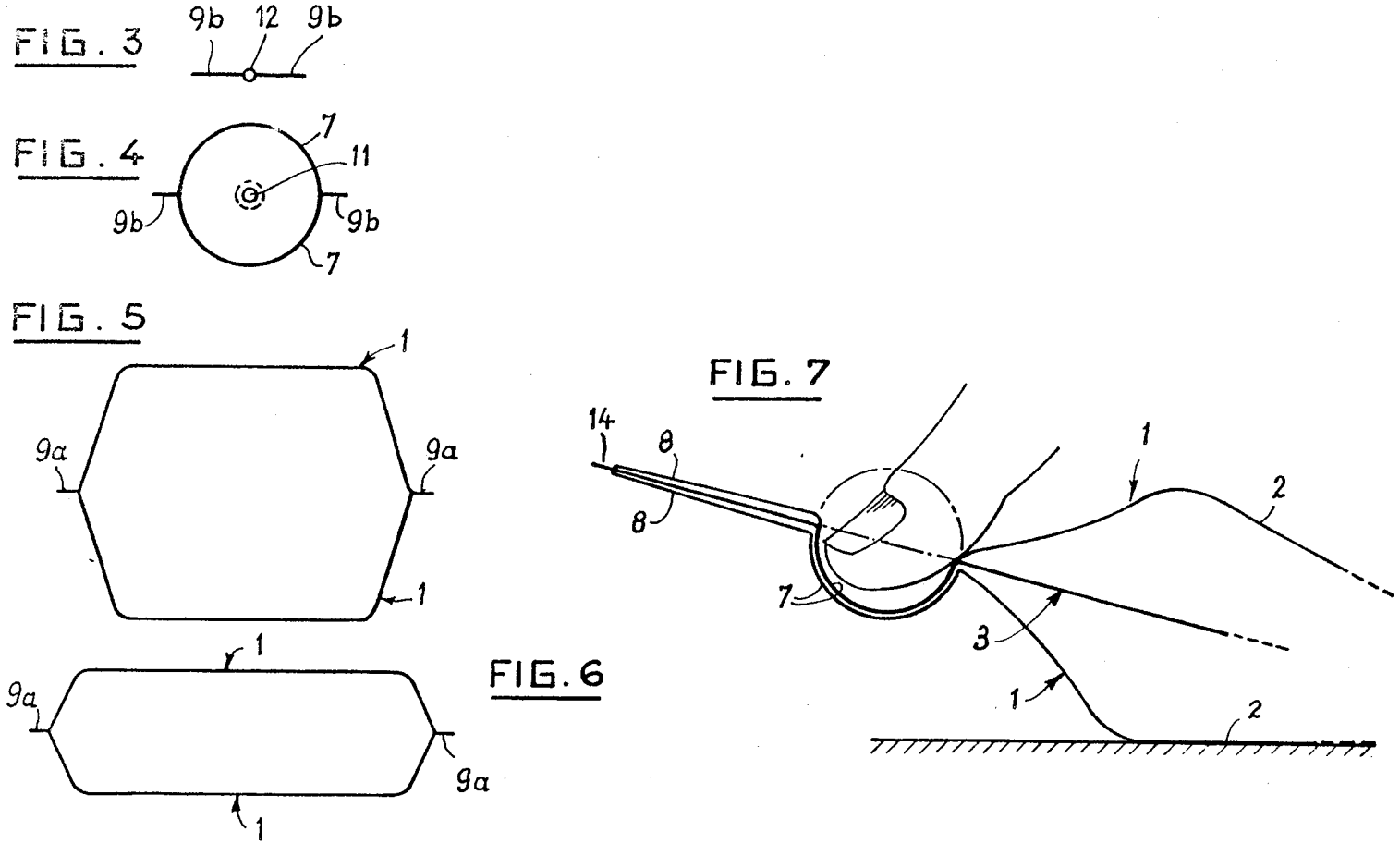
FIGS. 3 to 6 are cross-sectional views taken respectively along the lines III—III, IV—IV, V—V and VI—VI of FIG. 2.
FIG. 7 is a partial elevational view, similar to FIG. 1, showing the manner in which this container may be closed when it is not being used.

After having expelled a part of the liquid, the container can be closed by exerting a manual pressure on one of the semi-spherical bulging portions 7 (FIG. 7), so as to apply the latter against the interior of the second bulging portion 7. The two hemispherical bulging portions 7 then remain somewhat stuck together and the container is consequently closed. In order to expel the liquid again, it is sufficient to exert sufficient pressure on the two planar sides 2 to cause the liquid to separate the two hemispherical portions 7 and then reach the outlet passageway 12 through the spherical volume defined by the two bulging portions 7 and by the passageway 12.

The container according to the invention is much cheaper to produce than conventional containers owing to the simplicity of its structure. Further, the closure of the container by the application of the two hemispherical bulging portions 7 against each other still further reduces its cost relative to conventional bottles which must be provided with a cap which is produced apart from the body of the bottle.

Many modifications may be made in the container according to the invention and the scope of the invention is not intended to be limited to the described embodiment. Thus, the angle of the dihedron defined by the two planar sides 2 may vary widely while remaining less than 90°. Further, the bulging portions 7 may be replaced by portions having a non-hemispherical section.

Note that, owing to the inclination of the median assembly plane P relative to the horizontal plane which is equal to $\alpha/2$, the liquid outlet opening is always directed upwardly. Consequently, when the container rests by one of the sides 2 on the support plane 4, the liquid cannot in any way escape, even if the bulging portions 7 are separated from each other and if the container is flled with liquid, as is the case of the embodiment shown in FIG. 1.

It will also be observed that the distribution of the weight of the container, whether full or empty, is so chosen that the vertical through its center of gravity is located within the perimeter of one of the bearing sides 2. This therefore imparts an auto-stability to the container.

Owing to its low cost, the container may be thrown away after having been emptied of the liquid it contains.

What is claimed is:

1. A container of a semi-rigid material for receiving a liquid, manufactured from films, by molding, thermal blowing or thermal forming, comprising:

two semi-shells, each of which includes only one planar bearing side, forming together a dihedron which has an angle less than 90° when the container contains a liquid, and each having an extended portion opposite the apex of said dihedron to define when said shells are fixed together an extended neck having a liquid expelling opening at the outer end thereof, said container resting on only one of said sides when placed on a surface, said liquid expelling opening being located at a level higher than the maximum level of the liquid in said container when full and resting on one of said sides and when resting on the other of said one of said sides, so that liquid cannot accidentally flow out of said container; and means for fixing said semi-shells with each other along their peripheries in a meridian plane relative to which said semi-shells are symmetrical.

2. A container according to claim 1, wherein said fixing means comprises a welding between said semi-shells.

3. A container according to claim 1 comprising an enclosing means which closes said liquid expelling opening and which may be detached from said container so as to open said opening.

4. A container according to claim 1 wherein said fixing means comprises a bead along which said two semi-shells are assembled, said bead including a first loop portion on opposite sides of which two portions of said semi-shells incorporating said planar bearing sides are fixed, said loop portion having two convergent branches which are extended to define therebetween, together with said semi-shells, a cavity therein communicating with the interior of said container inward of said cavity, said branches having end portions beyond said cavity defining a liquid expelling passageway leading to the liquid expelling opening, and said cavity communicating with said passageway.

5. A container according to claim 4, wherein the two semi-shells each have a bulging portion defining said cavity, each of said portions being capable of being pushed against the other by application of pressure thereon so that said two bulging portions close the container by remaining stuck together.

* * * * *